US007080423B2

(12) United States Patent
Seber et al.

(10) Patent No.: US 7,080,423 B2
(45) **Date of Patent: *Jul. 25, 2006**

(54) HAND TOOL WITH MULTIPLE LOCKING BLADES CONTROLLED BY A SINGLE LOCKING MECHANISM AND RELEASE

(75) Inventors: Brett P. Seber, Escondido, CA (US); Randolph J. Morton, Coronado, CA (US); Gabriel Alejandro Draguicevich, Solana Beach, CA (US); Roy L. Helton, Jr., San Diego, CA (US); Gregory F. Rubin, Escondido, CA (US)

(73) Assignee: Leatherman Tool Group, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/892,960

(22) Filed: Jul. 16, 2004

(65) Prior Publication Data

US 2004/0255389 A1 Dec. 23, 2004

Related U.S. Application Data

(63) Continuation of application No. 10/309,735, filed on Dec. 3, 2002, now Pat. No. 6,802,094, which is a continuation of application No. 09/847,559, filed on May 1, 2001, now Pat. No. 6,487,740, which is a continuation of application No. 09/660,256, filed on Sep. 12, 2000, now Pat. No. 6,233,769, which is a continuation of application No. 09/060,768, filed on Apr. 14, 1998, now Pat. No. 6,170,104, which is a continuation of application No. 08/606,169, filed on Jan. 11, 1996, now Pat. No. 5,765,247.

(51) Int. Cl.
*B25B 7/22* (2006.01)

(52) U.S. Cl. ..... 7/128; 7/118; 7/125; 81/177.4; 81/177.6; 81/440; 81/490; 30/161; 30/152

(58) Field of Classification Search ..... 7/118, 7/125, 128; 81/177.4, 177.6, 440, 490; 30/161, 30/152

See application file for complete search history.

(56) References Cited

U.S. PATENT DOCUMENTS 97,154 A 11/1869 Barnard (Continued)

FOREIGN PATENT DOCUMENTS

CH 277412 11/1951

(Continued)

OTHER PUBLICATIONS

U.S. Appl. No. 07/337,371, filed 1989, Lemaire.

(Continued)

*Primary Examiner*—Lee D. Wilson
*Assistant Examiner*—Shantese McDonald
(74) *Attorney, Agent, or Firm*—Chernoff, Vilhauer, McClung & Stenzel, LLP

(57) ABSTRACT

A hand tool such as a knife or a combination tool includes multiple blades, each independently rotatable on a common axle between a closed position within a handle of the tool and an open position extending from the handle. Each blade is positively but releasably locked into its open position. Those blades which remain closed are biased toward the closed position when the opened blade is locked into position and also as it is opened and closed. A single locking, releasing, and biasing mechanism serves all of the blades in one handle.

9 Claims, 8 Drawing Sheets

U.S. PATENT DOCUMENTS

| | | | |
|---|---|---|---|
| 234,378 | A | 11/1880 | Pierce |
| 542,601 | A | 7/1895 | Baker |
| 589,392 | A | 8/1897 | Kolar |
| 592,766 | A | 11/1897 | Effinger et al. |
| 596,096 | A | 12/1897 | Watts |
| 614,537 | A | 11/1898 | Dahlquist et al. |
| 649,334 | A | 5/1900 | Meloos |
| 662,005 | A | 11/1900 | Lewis |
| 790,432 | A | 5/1905 | Heilrath |
| 857,459 | A | 6/1907 | Hendrickson |
| 858,003 | A | 6/1907 | Klever |
| 896,746 | A | 8/1908 | McCarty |
| 988,068 | A | 3/1911 | Beardsley et al. |
| 1,174,132 | A | 3/1916 | Dragun |
| 1,184,746 | A | 5/1916 | Hanson |
| 1,187,842 | A | 6/1916 | Kaas |
| 1,194,296 | A | 8/1916 | Jones et al. |
| 1,334,425 | A | 3/1920 | Wernimont |
| 1,362,142 | A | 12/1920 | Rohrer |
| 1,370,906 | A | 3/1921 | Newton |
| 1,467,661 | A | 9/1923 | Undy |
| 1,474,592 | A | 11/1923 | Jacoby |
| 1,486,725 | A | 3/1924 | Brown |
| 1,511,340 | A | 10/1924 | Jackson |
| 1,524,694 | A | 2/1925 | DiMaio |
| 1,551,328 | A | 8/1925 | Perry |
| 1,556,788 | A | 10/1925 | Hallvarson |
| 1,561,833 | A | 11/1925 | Cruickshank |
| 1,561,993 | A | 11/1925 | Nielsen |
| 1,619,181 | A | 3/1927 | Beretz |
| 2,057,201 | A | 10/1936 | McCluskey |
| D137,408 | S | 3/1944 | Frisk |
| 2,514,130 | A | 7/1950 | Jones |
| 2,561,682 | A | 7/1951 | Barnett |
| 2,575,652 | A | 11/1951 | Bovee |
| 2,606,471 | A | 8/1952 | Kollweck |
| 2,641,149 | A | 6/1953 | Peterson |
| 2,747,446 | A | 5/1956 | Eder |
| 2,779,098 | A | 1/1957 | Pocoski et al. |
| 2,814,108 | A | 11/1957 | Bassett |
| 2,824,368 | A | 2/1958 | Bassett |
| 2,832,135 | A | 4/1958 | Bassett et al. |
| 3,044,081 | A | 7/1962 | Robinson, Jr. |
| 3,364,508 | A | 1/1968 | Garrett |
| 3,798,687 | A | 3/1974 | Stevens |
| 4,040,181 | A | 8/1977 | Johnson |
| 4,238,862 | A | 12/1980 | Leatherman |
| 4,274,200 | A | 6/1981 | Coder |
| 4,302,877 | A | 12/1981 | Hart et al. |
| 4,502,220 | A | 3/1985 | Aoki |
| 4,512,051 | A * | 4/1985 | Magan ..... 7/128 |
| 4,535,539 | A | 8/1985 | Friedman et al. |
| 4,563,813 | A | 1/1986 | Fortenberry |
| D286,501 | S | 11/1986 | Magan |
| 4,741,106 | A | 5/1988 | Yamagishi |
| 4,744,272 | A | 5/1988 | Leatherman |
| 4,805,303 | A | 2/1989 | Gibbs |
| 4,888,869 | A | 12/1989 | Leatherman |
| 4,926,554 | A | 5/1990 | Martin |
| 5,029,355 | A | 7/1991 | Thai |
| 5,044,079 | A | 9/1991 | Gibbs |
| 5,062,173 | A | 11/1991 | Collins et al. |
| 5,142,721 | A | 9/1992 | Sessions et al. |
| 5,212,844 | A | 5/1993 | Sessions et al. |
| D338,386 | S | 8/1993 | Frazer |
| 5,267,366 | A | 12/1993 | Frazer |
| 5,320,004 | A | 6/1994 | Hsiao |
| D356,019 | S | 3/1995 | Sakai |
| 5,400,509 | A | 3/1995 | Collins |
| 5,511,310 | A | 4/1996 | Sessions et al. |
| 5,664,274 | A | 9/1997 | Collins |
| 5,697,114 | A | 12/1997 | McIntosh et al. |
| 5,745,997 | A | 5/1998 | Berg et al. |
| 5,978,993 | A | 11/1999 | Rivera |
| 5,979,059 | A | 11/1999 | Leatherman et al. |
| 6,088,861 | A | 7/2000 | Sessions |

FOREIGN PATENT DOCUMENTS

| | | |
|---|---|---|
| DE | 30788 | 3/1885 |
| EP | 0100 377 A1 | 2/1984 |
| GB | 2463 | 1/1869 |
| GB | 17248 | 6/1896 |
| GB | 20299 | 11/1902 |
| GB | 15859 | 9/1904 |
| GB | 13254 | 9/1905 |
| GB | 186520 | 10/1922 |
| SU | 1002145 | 3/1983 |

OTHER PUBLICATIONS

J. A. Henckels, "Mongin: World Class," *Knife World,* Mar. 1987, pp. 3-7 and 30-31.

* cited by examiner

HAND TOOL WITH MULTIPLE LOCKING BLADES CONTROLLED BY A SINGLE LOCKING MECHANISM AND RELEASE

CROSS-REFERENCE TO RELATED APPLICATIONS

This application is a continuation of application Ser. No. 10/309,735, filed Dec. 3, 2002, now U.S. Pat. No. 6,802,094, for which priority is claimed and whose disclosure is incorporated by reference in its entirety; which is a continuation of application Ser. No. 09/847,559, filed May 1, 2001, now U.S. Pat. No. 6,487,740, for which priority is claimed and whose disclosure is incorporated by reference in its entirety; which is in turn a continuation of application Ser. No. 09/660,256, filed Sep. 12, 2000, now U.S. Pat. No. 6,233,769, for which priority is claimed and whose disclosure is incorporated by reference in its entirety; which in turn is a continuation of application Ser. No. 09/060,768, filed Apr. 14, 1998, now U.S. Pat. No. 6,170,104, for which priority is claimed and whose disclosure is incorporated by reference in its entirety; which in turn is a continuation of application Ser. No. 08/606,169, filed Jan. 11, 1996, now U.S. Pat. No. 5,765,247, for which priority is claimed and whose disclosure is incorporated by reference in its entirety.

BACKGROUND OF THE INVENTION

This invention relates to hand tools with foldout blades, and, more particularly, to such hand tools with multiple foldout locking blades.

Hand tools with multiple deployable blades have long been known and used in the home, in the workplace, and in sporting applications. A folding pocket knife having two blades is an example. The blades are carried inside a handle for storage, and are selectively opened, one at a time, when required to perform specific functions.

Pocket-knife-like devices, such as those produced by Wenger and Victorinox and commonly called "Swiss Army" knives, use this same principle extended to a plurality of tools carried within the body of the knife on axles located at either end of the knife. Such implements typically incorporate a variety of types of blade-type tools, such as one or more sharpened blades, a screwdriver, an awl, a file, a bottle opener, a magnifying glass, etc. Generally, Swiss Army knives are designed to be sufficiently small and light for carrying in a pocket and are therefore limited as to the strength and robustness of their structure.

In recent years, devices known generically as "combination tools" have been developed and widely marketed. A combination tool is built around a jaw mechanism such as a full-size pliers head. The pliers head has handles fixed thereto. To make the combination tool compact yet capable of use in situations requiring the application of large forces, the handles are made deployable. To make the combination tool more useful, a number of blade tools, generally of the type found in the Swiss Army knife, are received in a folding manner within the handles themselves.

One useful feature of some conventional folding knives is the ability to positively lock the blade in the open position to prevent an unintentional closure during service that could cut the hand of the user. Lockbacks, sidelocks, axle locks, and other types of locks are known in the art. Another useful feature is the biasing of the blade toward its closed position from angular orientations close to the closed position. Such a biasing acts as a detent to prevent the blade from unintentionally folding open when carried or when another blade is already open and in use. The blade may also be biased toward its open position from angular orientations close to the open position. In either case, the biasing effect gives a secure feel to the closing and opening of the blades. Cam, backspring, ball detent, and other types of biasing structures are known in the art.

Positive locks used in conjunction with biasing structures are desirable features of knives, but they have not been successfully utilized in knives having multiple blades rotating in the same direction on a common axle. (When the term "blade" or "blade tool" is used herein in reference to deployable tools received into the handle of the combination tool, knife, or other type of tool, it refers to any relatively thin tool that is folded into the handle, regardless of the utilization of the tool. Such a "blade" therefore includes, but is not limited to, a sharpened knife blade, a serrated blade, a screwdriver, an awl, a bottle opener, a can opener, a saw, a file, etc.) Existing approaches have internal structures that require too much space when adapted for use on several side-by-side blades, or the locking release controls take up too much space or are inconvenient. For example, a typical combination tool has four or more blades folding from a common axle in each handle, where the width of the handle—the required envelope size within which the entire structure must fit—is on the order of about 1 inch or less. The sides of the handle, the blades, and any locking and biasing mechanism must fit within that width, and the externally accessible lock releasing structure must also fit on the outside of the handle within that width. If the width of the handle of the hand tool is increased significantly above about 1 inch, the combination tool will no longer be comfortable in the hand. There have been some attempts to provide a positive lock for the blades of a combination tool, but they have been highly inconvenient to use in practice.

There is a need for an approach to locking and biasing multiple, side-by-side blades of combination tools, knives, and other types of hand tools where the blades pivot on a common axis. The present invention fulfills this need, and further provides related advantages.

SUMMARY OF THE INVENTION

The present invention provides a hand tool wherein multiple blades pivot on a single axle. The blades are each positively locked into their open positions by a single strong locking mechanism. The blades are also biased toward their closed positions and their open positions. When one blade is opened, the others stay in their closed positions. The opened blade is positively locked and later unlocked without moving the other blades from their closed positions. The locking and biasing mechanism fits within the envelope size required for a hand tool, and has been demonstrated operable for four blades within a space of less than 1 inch width.

In accordance with the invention, a hand tool comprises a tool body having a pair of oppositely disposed sides, an axle extending transversely between the sides of the body at one end of the tool body, and at least two blades supported on the axle. Each blade includes a blade base having a peripheral surface and an implement extending outwardly from the blade base, and further has a bore through the blade base with the axle extending through the bore so that the blade base and thence the blade is rotatable on the axle between a closed position wherein the blade is contained within the tool body and an open position wherein the blade extends from the tool body. There is a notch in the peripheral surface of the blade base. A single rocker is supported on the tool body and has a locking finger extending therefrom. The locking finger is dimensioned and positioned to engage the notch of each blade base when the blade is in the open position. A biasing spring reacts against the single rocker in a direction so as to force the locking finger against the peripheral surface of the blade base.

There is, additionally, means for biasing one of the blades toward the open position while biasing all others of the blades toward the closed position. This biasing means preferably takes the form of a first cam surface on the peripheral surface of each blade base at a location adjacent to the notch, having a first cam maximum surface height and a first cam maximum surface height angular position, and a second cam surface on the peripheral surface of the blade base at a location remote from the notch, having a second cam surface height less than the first cam surface height and a second cam maximum surface height angular position located about 110 to about 120 degrees from the first cam maximum surface height angular position. The first cam maximum surface height is preferably slightly smaller than the second cam maximum surface height.

Thus, the invention provides a locking/biasing mechanism that positively locks any one of the blades into its open position while biasing the remaining blades toward their closed positions. The locking mechanism has a single release that releases the blade that is locked into the open position. As the selected blade is opened or closed against its biasing force, the other blades remain in their closed positions under the influence of their biasing forces. Subsequently, a different blade may be selected for opening, with the same results and performance.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

BRIEF DESCRIPTION OF THE DRAWINGS

FIG. 8 are a series of schematic elevational views of the operation of the locking and biasing mechanism as a blade is operated, wherein

FIGS. 14A–D illustrate a pliers head serrated grip operable for gripping a wide variety of bolt head sizes, wherein FIG. 14A illustrates the gripping of a 1-inch bolt head, FIG. 14B illustrates the gripping of a ¾-inch bolt head, FIG. 14C illustrates the gripping of a ½-inch bolt head, and FIG. 14D illustrates the gripping of a ¼-inch bolt head.

DETAILED DESCRIPTION OF THE INVENTION

Figure 1:
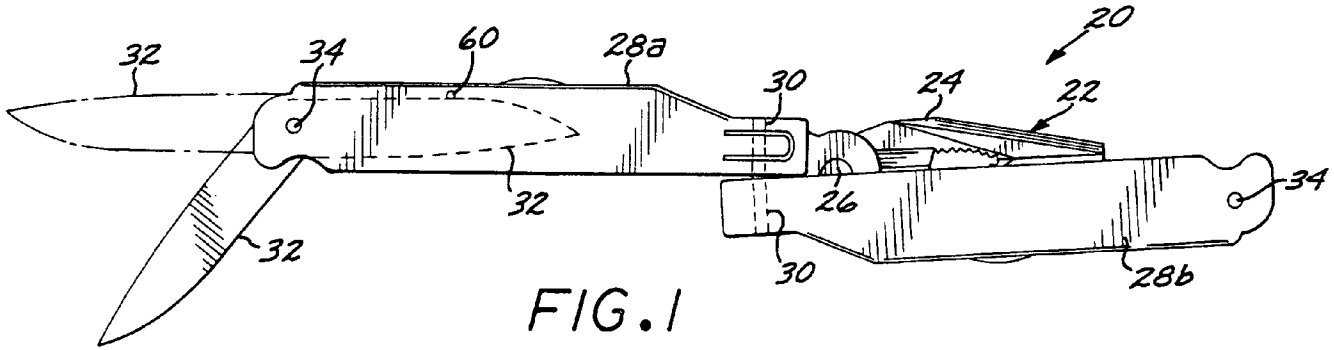
FIG. 1 is an elevational view of a combination hand tool with multiple blades in one handle and one of the blades opened.

FIG. 1 illustrates a hand tool in the form of a combination tool 20 including a jaw mechanism 22 with two jaws 24 pivotably connected by a jaw pivot 26. Two handles 28 are deployably connected to the jaws 24 by handle pivot pins 30. The handles 28 are channel sections. In the view of FIG. 1, one of the handles 28*a* is in a deployed position and the other of the handles 28*b* is in a nested position. A number of different combination tools of various configurations are known, see, for example, U.S. Pat. Nos. 4,238,862; 4,744,272; 5,142,721; 5,212,844; 5,267,366; and 5,062,173, whose disclosures are incorporated by reference, and several types are available commercially.

In the combination tool 20, those described in the referenced patents, and those available commercially, it is common practice to affix a plurality of blade tools 32 in each of the handles 28 to increase the utility of the combination tool. The blade tools 32 are pivotably connected by a tool pivot axle 34 to the handles 28 at the ends remote from the pivot pins 30. Each of the blade tools 32 can be closed to lie within the channel sections of the handles 28 or opened to extend from the handle 28 to perform their function or positioned at an intermediate position, as shown in the three positional indications in FIG. 1. When the term "blade" or "blade tool" is used herein in reference to deployable tools received into the handle of the combination tool or other type of tool, it refers to any relatively thin tool that is folded into the handle, regardless of the utilization of the tool. Such a "blade" therefore includes, but is not limited to, a sharpened knife blade, a serrated blade, a screwdriver, an awl, a bottle opener, a can opener, a saw, a file, etc. This terminology is used to distinguish the tool folded into the handle from the overall hand tool, in this case of the combination tool 20.

Figure 2:
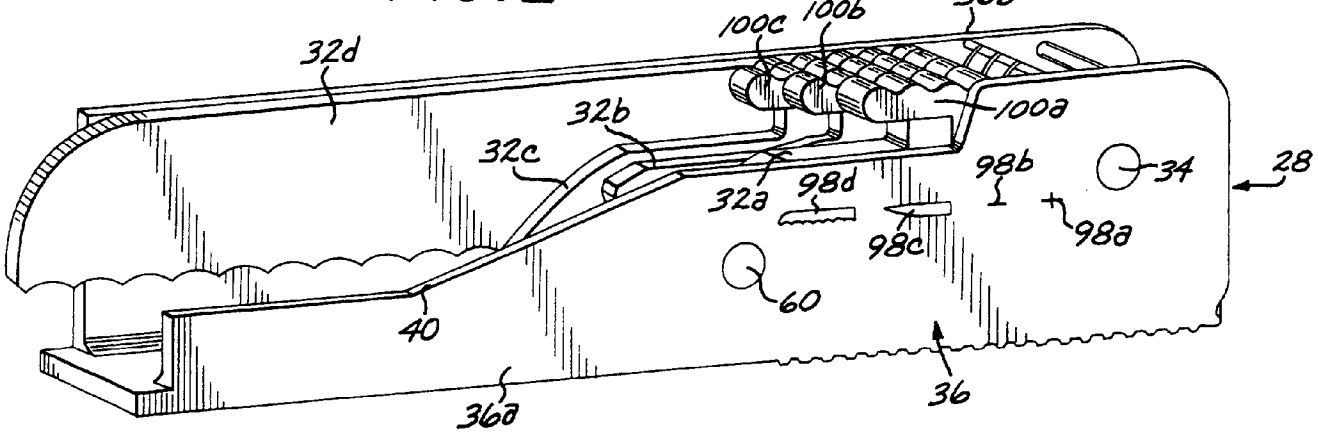
FIG. 2 is a perspective view of the handle of the combination tool of FIG. 1.

The combination tool 20 has at least two, and more typically 3–4 or more, of the blade tools 32 arranged on the axle 34 of each handle 28, as seen in FIG. 2 for the case of four blade tools 32*a*, 32*b*, 32*c*, and 32*d*, all of which open in the same rotational direction. FIG. 2 also shows the channel-shaped section of the handle 28, having two sides 36*a* and 36*b* and a web 38 connecting the two sides 36*a* and 36*b*. The tool pivot axle 34 extends between the two sides 36*a* and 36*b*.

In the preferred approach, one of the sides 36*a* has a cut-down region 40 to permit easy manual access to the blade tools 32 when they are to be opened. (The cut-down region 40 is generally configured to follow the profile of one of the jaws 24 so that the jaw mechanism 22 can be nested between and within the handles 28*a*, 28*b* when the combination tool 20 is nested for storage.) The blade tools 32 are arranged so that the longest of the blades 32*d* is adjacent to the side 36*b* which is not cut down, and the shortest of the blades 32*a* is adjacent to the side 36*a* having the cut-down region 40.

Two convenience features are provided on the combination tool to aid in the locating and opening of the selected blade tool 32, as illustrated in FIG. 2. Experience with Swiss Army knives and commercial combination tools has shown that the identifying and opening the desired one of the blade tools can be difficult, particularly under adverse conditions of darkness, wet surfaces, etc.

To aid in locating a specific blade tool of interest, icons 98 are positioned on the externally facing surfaces of the sides 36 of the handles 28. The icons 98 are standardized pictorial identifiers of the types of blade tools in the handle and their order of positioning in the handle. As an example shown in FIG. 2, an icon 98*a* in the form of a "+" sign identifies a conventional four-armed Phillips head screwdriver, an icon 98*b* in the form of a "–" identifies a flat blade screwdriver, an icon 98*c* in the form of a blade identifies a sharpened blade, and an icon 98*d* in the form of a blade with serrations identifies a serrated blade. Larger icons are used to identify larger tools, such as larger screwdrivers. With some familiarizing practice, the user of the combination tool quickly becomes adept at locating a desired blade tool by either sight or finger touch.

To aid in the opening of the selected blade tool 32, at least some of the blade tools include an integral lifting lever 100 extending upwardly from the implement so as to be accessible from the open side of the channel-shaped section and also from the cut-down side 36*a*. The lifting levers 100 are graduated in length so that the lifting lever 100*a* closest to the cut-down side 36*a* is short, and the lifting levers 100*b* and 100*c* further from the cut-down side are progressively longer. The lifting levers 100 aid the user of the combination tool in readily opening the selected blade tool against the biasing force that tends to hold the selected blade tool in its closed position. As illustrated in FIG. 2, the longest of the blade tools 32*d* can often be made without a lifting lever, because it may be readily grasped without any such lever.

Figure 3:
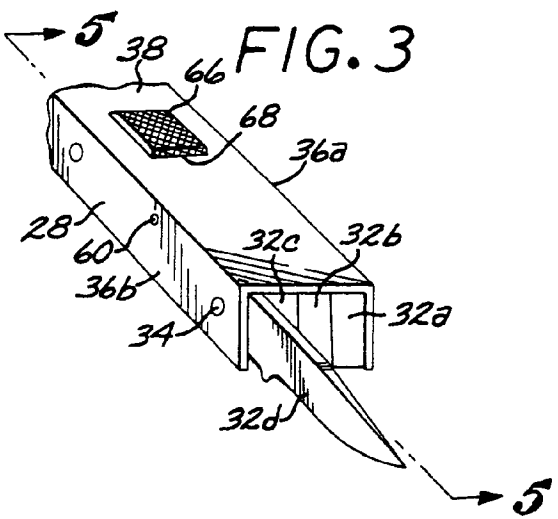
FIG. 3 is another perspective view of the handle of the combination tool of FIG. 1, with the handle inverted from the view of FIG. 2.

FIG. 3 illustrates the handle 28 in a view inverted from that of FIG. 2, and with one of the blade tools 32*d* opened by rotating it on the pivot axle 34. In normal use, only one of the blade tools 32 is opened at a time, with the others remaining closed and within the handle 28. If the generally flat blade tools 32 were positioned too closely adjacent to each other in a touching contact, as is the case in some commercially available combination tools, the friction between the touching surfaces of adjacent blade tools would tend to cause a blade tool to be unintentionally dragged open as one of the other blade tools was intentionally opened. In the present approach, illustrated in FIG. 4, a washer 42 is placed between each pair of blade tools 32 and between the last blade tool on the axle and the interior of the side 36 of the handle 28. (In FIG. 4, the spacings between the blade tools 32, into which the washers 42 are received, are exaggerated as a viewing aid.) Because the width dimension W of the handle 28 is typically small, on the order of about ½ inch, conventional thick metal washers are preferably not used. Instead, the washer 42 is preferably made of a polymeric material, most preferably polypropylene, polyethylene; or polytetrafluoroethylene (teflon), about 0.010 thick. Such washers can be prepared economically by a cutting or stamping process on a sheet of teflon adhered to a substrate carrier with a pressure-sensitive adhesive, to produce annular washer shapes. The individual washers are peeled off the substrate carrier and affixed to the opposite sides of the blade tools 32 overlying a bore 44 through which the tool pivot axle 34 passes. The washer may also be obtained as a separate article and assembled with the blade tools 32 and the axle. In another approach, the washer may be formed as a raised annular area of the blade tool surrounding the bore 44.

Figure 5:
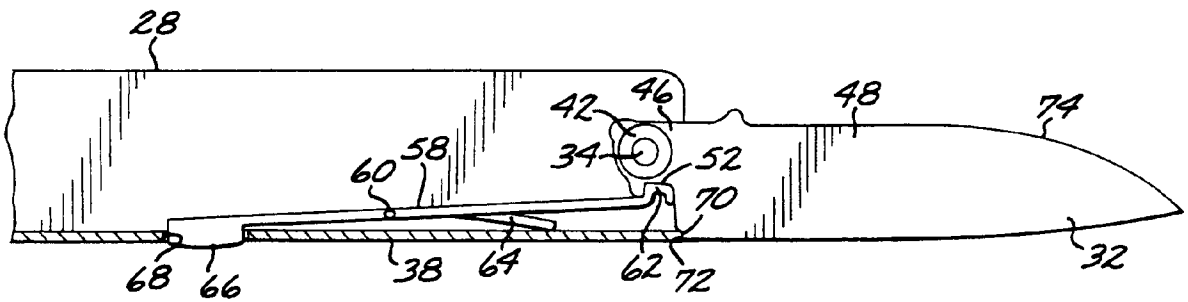
FIG. 5 is a schematic sectional view of the handle of the combination tool of FIG. 1, taken along lines 5—5 of FIG. 3.

FIG. 5 shows a preferred form of the locking and biasing mechanism. The blade tool 32 includes a blade base 46 and an implement 48 extending outwardly from the blade base 46. The implement may be any generally flat, operable type of implement such as a sharpened knife blade (as illustrated), a serrated blade, a screwdriver, an awl, a bottle opener, a can opener, a saw, a file, etc. The implement 48 is preferably integral with the blade base 46, although it can be made detachable.

Figure 6:
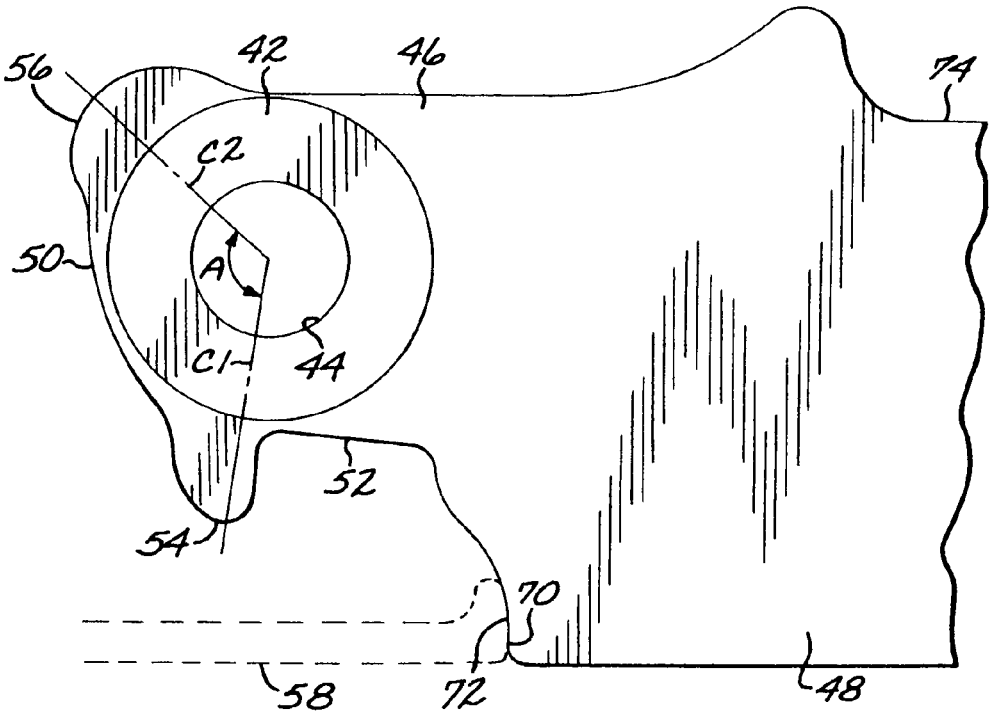
FIG. 6 is an elevational view of the blade base.

The blade base 46, shown in greater detail in FIG. 6, is generally flat and thin, on the order of about 0.05 to about 0.20 inches thick, and includes the bore 44 extending therethrough and the washer 42 around the bore. (The blade bases of the various blade tools need not be of the same thicknesses.) The tool pivot axle 34 extends through the bore 44. The blade base 46 is laterally bounded generally on three sides by a peripheral surface 50, and contiguous with the implement 48 on the fourth side. The peripheral surface 50 includes a generally straight-sided, flat-bottomed notch 52. Immediately adjacent to the notch 52, on the side remote from the implement 48, is a first cam surface 54. More remote from the notch 52 is a second cam surface 56. The first cam surface 54 is characterized by a first cam maximum surface height measured as a maximum distance to the peripheral surface 50 along a radius from the center of the bore 44 of C1 and passing through the first cam surface 54. The second cam surface 56 is characterized by a second cam maximum surface height measured as a maximum distance to the peripheral surface 50 along a radius from the center of the bore 44 of C2. In the preferred approach, C2 is greater than C1, preferably by about 0.005 inches in a typical case. In a prototype combination tool prepared by the inventors, C1 is about 0.220 inches and C2 is about 0.225 inches. The height of the peripheral surface is reduced between the first cam surface 54 and the second cam surface 56. In a preferred embodiment, the first cam maximum surface height of the first cam surface 54 is positioned about 6 degrees away from the adjacent edge of the notch 52. The second cam maximum surface height of the second cam surface 56 is positioned about 118.5 degrees from the first cam maximum surface height.

Referring to FIG. 5, a single rocker 58 is a planar piece of spring steel lying generally parallel to the long axis of the handle 28. The rocker 58 is pivotably supported on a rocker axle 60 that extends between the sides 36*a* and 36*b*. Only one rocker 58 is provided for two or more blade tools 32. At a first end of the rocker 58 a locking finger 62 extends from one face of the rocker 58 toward the blade base 46. The locking finger 62 is positioned and dimensioned to contact the peripheral surface 50. The locking finger 62 has a straight-sided, flat-topped configuration that is received into the notch 52 in a locking engagement, when the locking finger 62 and the notch 52 are placed into a facing relationship with the locking finger 62 biased toward the notch 52.

Figure 7:
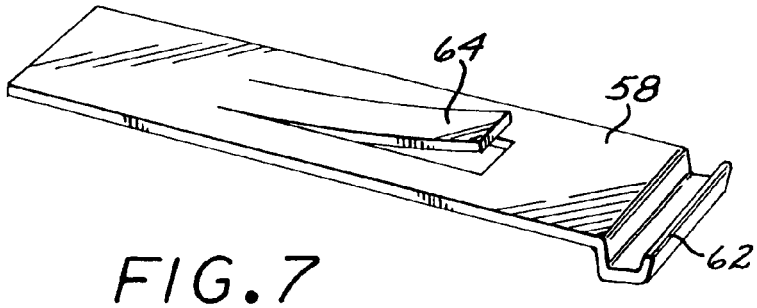
FIG. 7 is a perspective view of the rocker and biasing spring.

The rocker 58 is biased so that the locking finger 62 is forced toward the peripheral surface 50 by a spring. The spring may be of any form, but, as seen in FIG. 7, it is preferably a leaf 64 formed by slitting the rocker 58 parallel to its sides and one end, and bending the leaf portion within the slits away from the plane of the rocker 58. The rocker 58 is assembled with the leaf 64 contacting the web 38 portion of the handle 28. The leaf 64 is compressed when the rocker axle 60 is assembled into place, so that the rocker 58 and thence the locking finger 62 is biased toward the peripheral surface 50 of the blade base 46. Equivalently, the spring that biases the rocker may be a leaf extending from the web 38 as an integral element or an attachment to the web, or a cantilevered spring extending from the handle.

At the end of the rocker 58 remote from the locking finger 62, and on the opposite side of the rocker 58, is a pad 66. A window 68 is formed through the web 38 of the handle 28, and the pad 66 faces the window 68 (see also FIG. 3). The blade tool 32 is positively locked into position against motion in either rotational direction when the blade tool 32 is fully opened to the position shown in FIG. 5, and the locking finger 62 engages the notch 52. The locking finger 62 is lifted out of the notch 52 by manually pressing inwardly on the pad 66, to achieving unlocking of the blade tool 32. All of the blade tools 32 have a structure of the type described above, but there is a single locking finger 62 that achieves the locking of all of the blade tools 32.

Additionally, as can best be seen in FIG. 6, there is desirably a shoulder 70 on the implement 48 that is in facing relation to a rounded end 72 of the web 38. This engagement of the shoulder 70 to the end 72 provides an additional interference restraint of the blade tool 32 that resists rotation of the implement 48 in the clockwise direction of FIGS. 5 and 6. This additional restraint is particularly valuable where the implement 48 is of a type where it is forced in the clockwise direction during service, such as a blade having a sharpened edge 74 that is forced downwardly during cutting operations. The blade tool is preferably dimensioned so that there is a gap of about 0.005 inches between the shoulder 70 and the end 72 of the web 38 when no load is applied to the blade tool. When a sufficient load is applied to produce a 0.005 inch deflection, the shoulder 70 contacts the end 72 to stop any further movement.

Figure 8A:
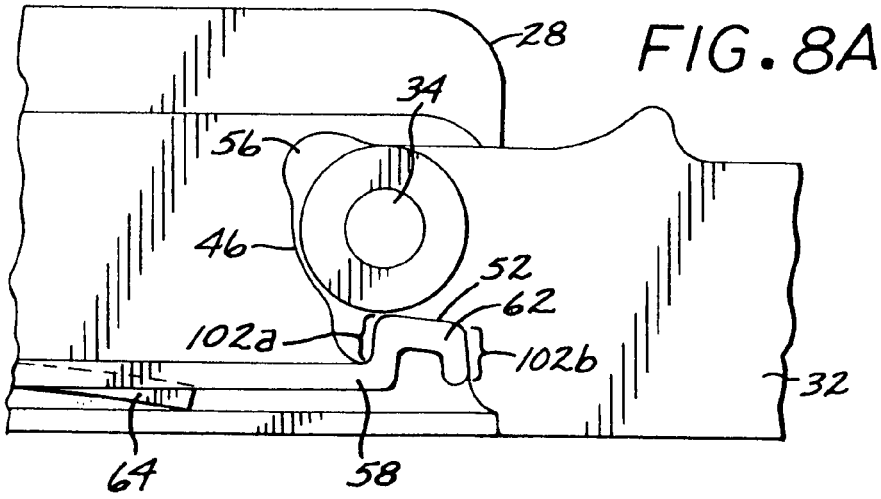
FIG. 8A shows the blade in the fully open and positively locked position.
Figure 8B:
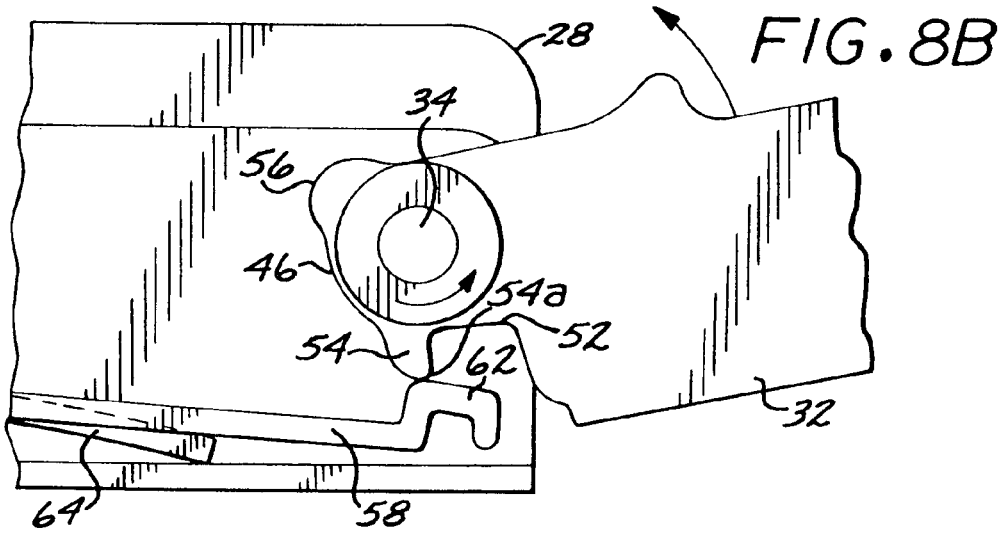
FIG. 8B shows the blade after manual unlocking but while biased toward the open position.
Figure 8C:
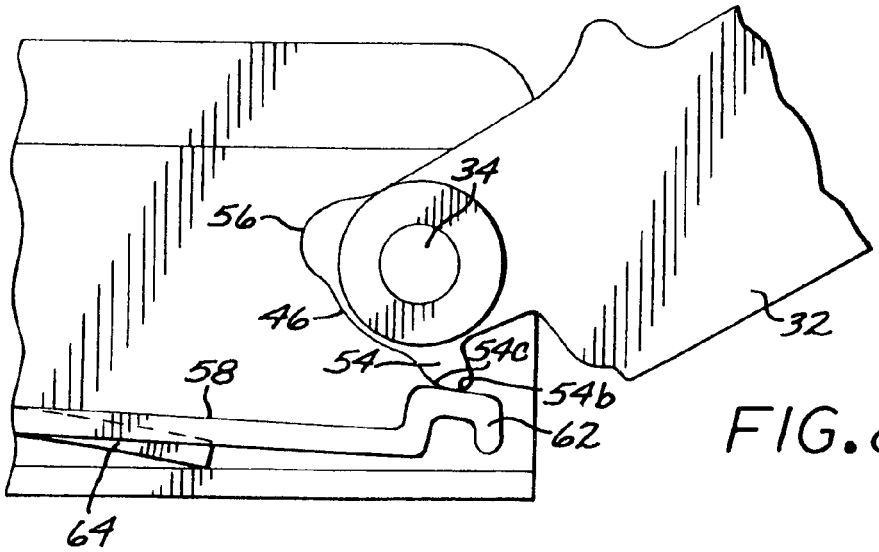
FIG. 8C shows the blade at an intermediate position biased toward the closed position.
Figure 8D:
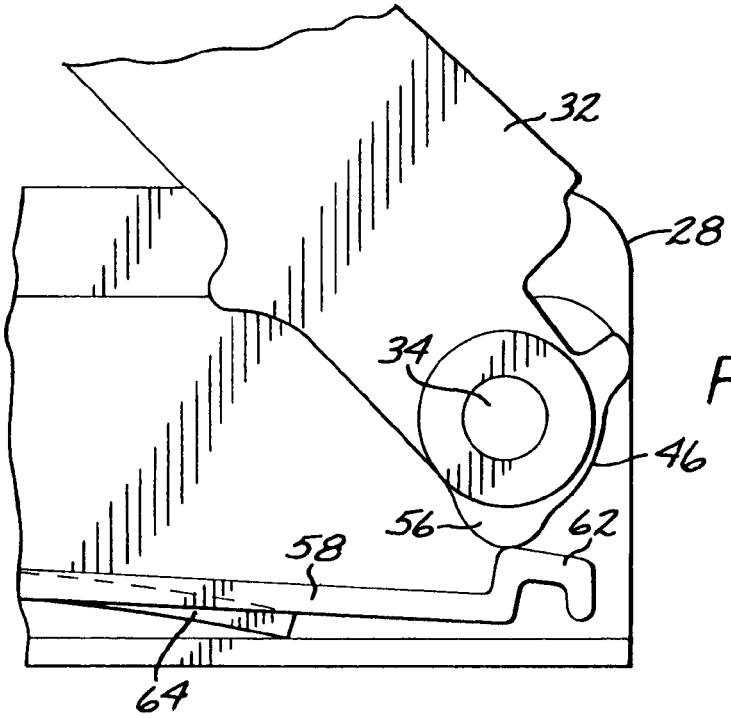
FIG. 8D shows the blade approaching the closed position.
Figure 8E:
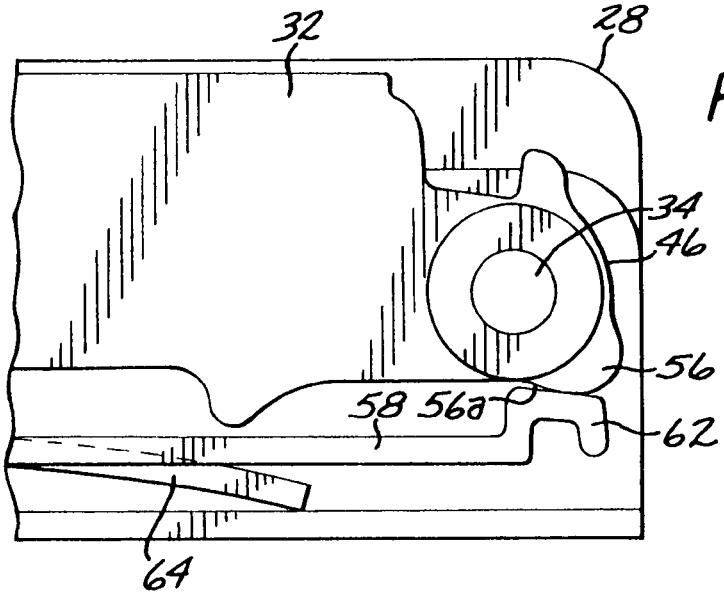
FIG. 8E shows the blade in the closed position.

FIG. 8 depict the operation of the locking/biasing mechanism in a series of views as a single blade tool 32 is moved from the open and positively locked position (FIG. 8A) to the closed and biased closed position (FIG. 8E). In FIG. 8A, the blade tool 32 is open, and the locking finger 62 is received into the notch 52, forming a positive lock of the blade tool 32 into the open position. The notch 52 and the locking finger 62 are cooperatively dimensioned so that the locking finger 62 rests against the sides of the notch along a locking distance 102*a* and 102*b* of about 0.030 to about 0.060 inches, most preferably about 0.040 inches, and does not bottom out in the notch. If the locking distance is significantly greater than about 0.060 inches, the blade tool will not lock securely. If the locking distance is significantly less than about 0.030 inches, the locking finger 62 may pop out of the notch 52 to unintentionally release the lock under moderate applied loads.

In FIG. 8B, the pad 66 has been depressed to lift the locking finger 62 out of the notch 52 (as previously described in relation to FIGS. 3, 5, and 6), and the user of the tool has manually rotated the blade in a counterclockwise direction by about 10 degrees. The blade tool 32 remains biased toward the open position, because the locking finger 62 rests against the sloping cam surface 54*a* that slopes back toward the notch 52.

After only a slight additional rotation of the blade tool 32 in the counterclockwise direction, FIG. 8C, the locking finger 62 has passed the first cam maximum surface height location 54*b* and is contacting the portion of the first cam surface 54*c* that slopes away from the notch 52. If the blade tool 32 is released at this point, it tends to move toward the closed position rather than the open position.

Further counterclockwise rotation of the blade tool 32 brings the locking finger 62 into contact with the second cam surface 56, FIG. 8D. An additional counterclockwise rotation of the blade tool 32 brings the locking finger 62 into contact with the portion 56*a* of the second cam surface 56 that slopes toward the closed position and thereby biases the blade 32 toward the closed position, FIG. 8E. The blade 32 is thereby forced toward the closed position and retained there. To move the blade 32 away from the closed position of FIG. 8E and back toward the orientation of FIG. 8D requires that the user manually overcome the bias force resulting from the reaction of the rocker 58 and its locking finger 62 against the cam surface 56*a*.

A comparison of the effects on the blade tool 32 of the reaction between the locking finger 62 and the peripheral surface of the blade base 46 in FIGS. 8A and 8E illustrates the difference between "positive locking" of the blade tool and "biasing" of the blade tool. In FIG. 8A, the reception of the locking finger 62 into the notch 52 provides a positive lock from which the blade tool 32 cannot be moved by the application of any ordinary manual force to the blade tool 32. Intentional release of the positive lock by manually pressing the pad 66 is required in order to move the blade tool 32 from its positively locked position. On the other hand, the biasing of the blade tool 32 toward a position, illustrated for the biasing toward the closed position in FIG. 8E, is produced in the preferred embodiment by a cam action which can be readily overcome with ordinary manual force on the blade tool. This distinction between positive locking and biasing is important. Biasing is readily achieved for blade tools 32 in a confined space, but positive locking is difficult to achieve in a confined space such as that available in a typical combination tool wherein 3–4 or more blade tools are supported in a narrowly confined space in each handle. For example, the multiple blade tools of Swiss Army knives are typically biased toward both the open and closed positions, but they are not typically provided with a positive lock in the open position.

Figure 4:
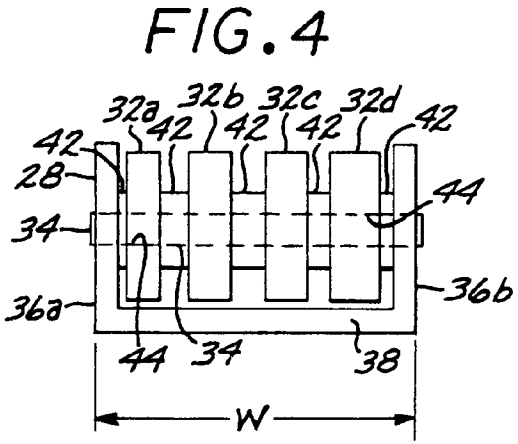
FIG. 4 is an schematic end view of the handle of the combination tool of FIG. 1, with the separations between elements exaggerated for clarity.
Figure 9:
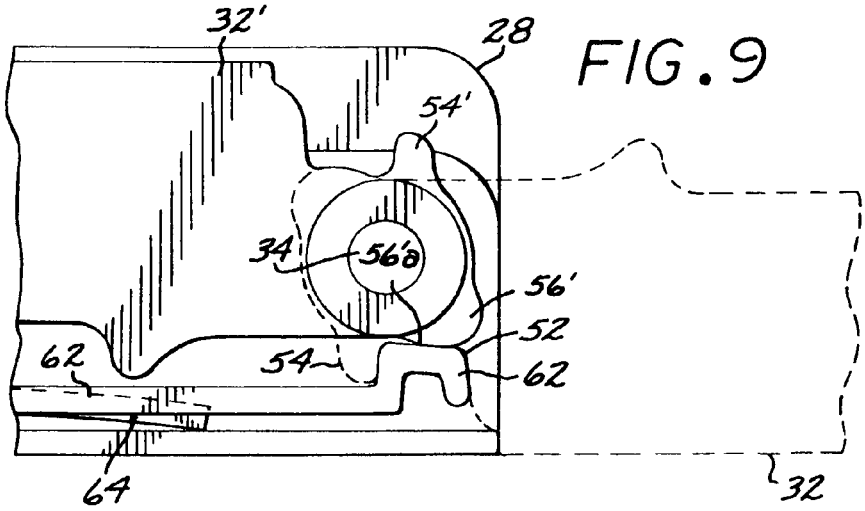
FIG. 9 is a schematic elevational view of the operation of the locking and biasing mechanism, with two blades, one open and positively locked and the other closed.

An important feature of the present approach is that the blade tool selected for opening and use is positively locked into the open position, while the remaining blade tools that have not been selected remain biased toward their closed position. The origin of this feature is illustrated in FIG. 9, which superimposes views of an open and positively locked blade tool 32 and a closed and biased closed blade tool 32'. At the same time that the locking finger 62 is received into the notch 52 of the positively locked blade tool 32, the locking finger 62 rests against the slope 56'*a* of the second cam surface 56' of the biased closed blade tool 32'. The locking finger 62 both positively locks the blade tool 32 open and biases the blade tool 32', closed. The same bias-closed effect is operable for all of the blade tools which are not open and in use. In a typical case wherein there are four blade tools such as shown in FIGS. 2–4, there is a single blade tool 32 which is open and positively locked and three blade tools 32' which are biased closed.

Figure 10:
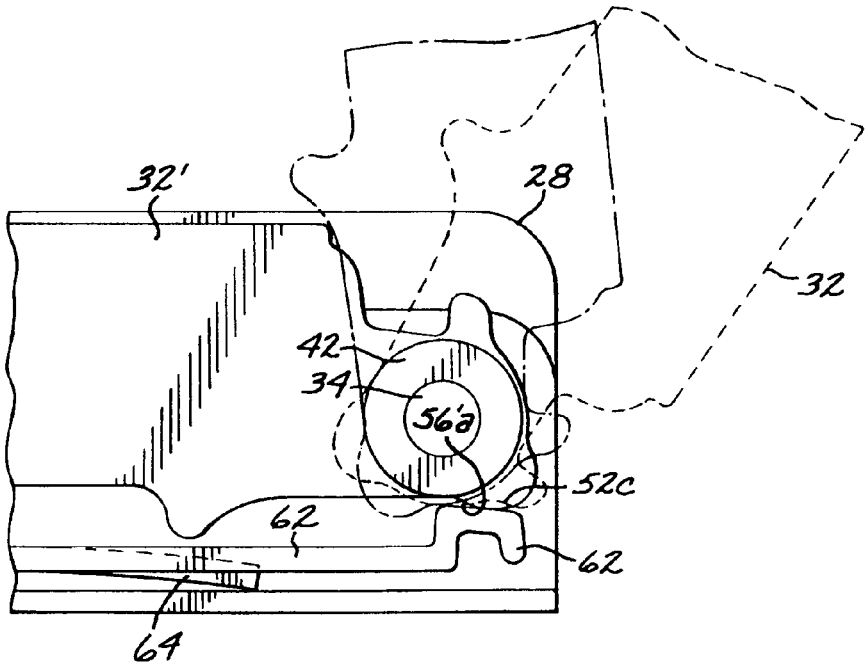
FIG. 10 is a schematic elevational view of the operation of the locking and biasing mechanism, with two blades, one in an intermediate position and the other closed.

A further important feature is that the blade tool 32' remains biased toward the closed position as the blade tool 32 is opened and closed. As shown in FIG. 10, at an intermediate stage of rotation of the blade tool 32 between its closed and open positions, the locking finger 62 continues to rest against the slope 56'*a* of the second cam surface, 56' of the closed blade tools 32', biasing them toward the closed position. The closed blade tools 32' therefore do not unintentionally open as the intentionally opened blade tool 32 is rotated. With this camming approach, there is an unavoidable small range of the rotation of the blade tool 32 (as the locking finger 62 passes over the top of the second cam 56) where the locking finger 62 is raised off the slope 56'*a* to release the biasing of the blade tools 32' toward the closed position. This small range of release of biasing is not noticeable to most users of the combination tool as they close or open the blade tool 32 in a smooth motion, and for most orientations of the tool.

Most of the discussion of the rotation of the blade tools in relation to FIGS. 8-10 has been in regard to the closing of the previously opened blade tool 32. The present approach provides an important advantage when the selected blade tool 32 is being opened as well. If FIG. 10 is viewed as one moment during the opening of the selected blade tool 32 (i.e., clockwise rotation of the blade tool 32), the biasing force of the locking finger 62 on the cam surfaces 56' tends to retain the other blade tools 32' in the closed position. Tests with prototype combination tools have shown that the cooperation of this biasing action on the blade tools 32' and the use of the washers 42 to reduce the frictional forces between the blade tool 32 that is being manually rotated and the blade tools 32' which are to remain closed causes the blade tools 32' to either remain in the fully closed position or to rotate back to the fully closed position after a small rotation away from the fully closed position. Thus, the user of the tool is afforded the convenience of opening, positively locking, later manually unlocking, and closing any of the selected blade tools while the others of the blade tools are automatically retained in the closed position.

Figure 11:
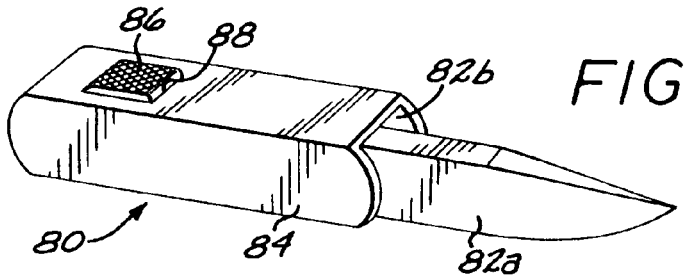
FIG. 11 is a schematic view of a knife using the approach of the invention.

The locking/biasing mechanism has been discussed in relation to the blade tools of the combination tool 20, but it is equally applicable to other hand tools which have openable blade tools. FIG. 11 depicts a knife 80 having two blade tools 82, a blade tool 82*a* illustrated in the open and positively locked position and a blade tool 82*b* illustrated in the closed and biased closed position. The knife 80 has a tool body 84 and a locking/biasing mechanism for the two blade tools 82 that is within the tool body and is the same as that discussed previously. The locking/biasing mechanism is not visible in FIG. 10 except for an unlocking pad 86 visible through a window 88, which are analogous to the pad 66 and window 68 discussed previously. In the knife and the combination tool and other embodiments, the locking/biasing mechanism need not control all of the blade tools that open from a handle—only two or more. Thus, there could be two locking/biasing mechanisms in a single handle, each controlling two blade tools, and there would be two unlocking pads.

As discussed previously, size constraints are important considerations in the design of a combination tool. Two modifications in the design of specific implements and one modification in the design of the pliers jaw mechanism have been developed to achieve a desired performance or even improved performance in a reduced available space.

Figure 12A:
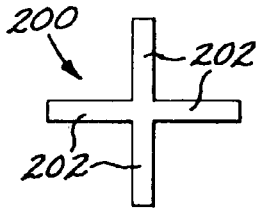
FIG. 12A illustrates in an end-on elevational view a conventional Phillips screwdriver head.
Figure 12B:
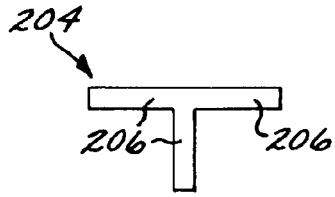
FIG. 12B illustrates in an end-on elevational view a modified Phillips screwdriver head.

In the first modification, illustrated in FIGS. 12A and 12B, the design of a Phillips screwdriver head 200 is modified. A conventional Phillips screwdriver head 200 of FIG. 12A has four arms 202 to engage the corresponding recesses in the head of a Phillips screw. In building a prototype combination tool, it was found that such a large Phillips screwdriver could not be readily accommodated within the available space envelope along with the nested pliers head and the other blade tools. As an alternative, a modified Phillips screwdriver head 204 of FIG. 12B was prepared having only three arms 206. Tests of the three-armed modified Phillips screwdriver head 204 showed that its performance is comparable with that of the standard four-armed Phillips screwdriver head 200 in most instances. In some cases, as where the recesses in the head of the Phillips screw have been deformed or damaged, the performance of the modified three-armed Phillips screwdriver head 204 may be superior to that of the conventional Phillips screwdriver head 200.

Figure 13A:
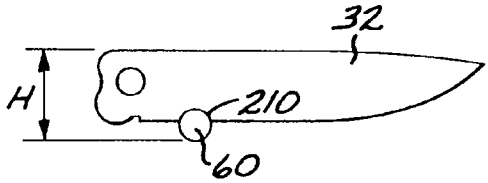
FIG. 13A illustrates in elevational view a modified blade tool having a stop recess.
Figure 13B:
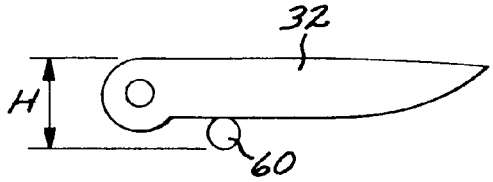
FIG. 13B illustrates in elevational view the shape of the blade tool in the absence of the stop recess.
Figure 14A:
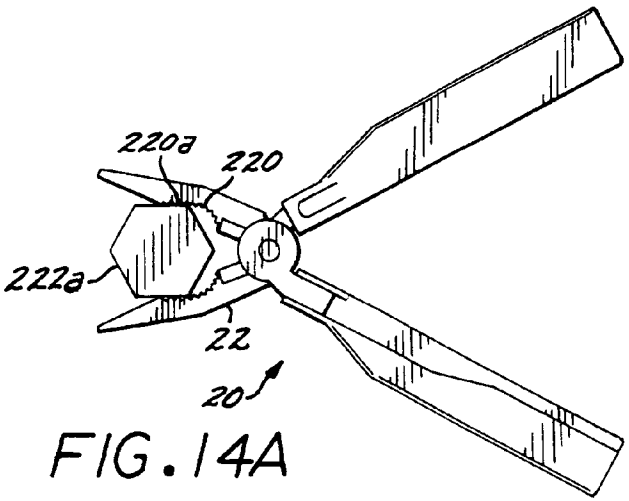
Figure 14B:
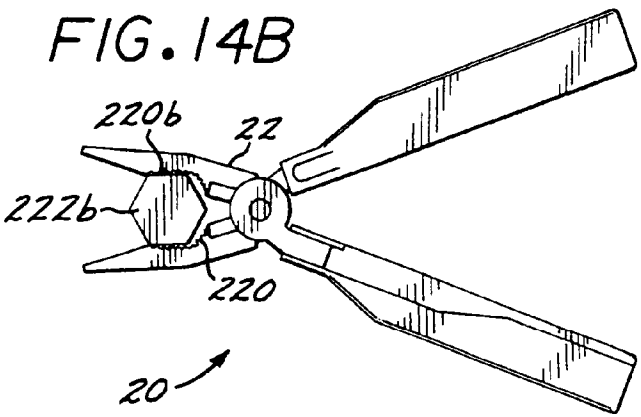
Figure 14C:
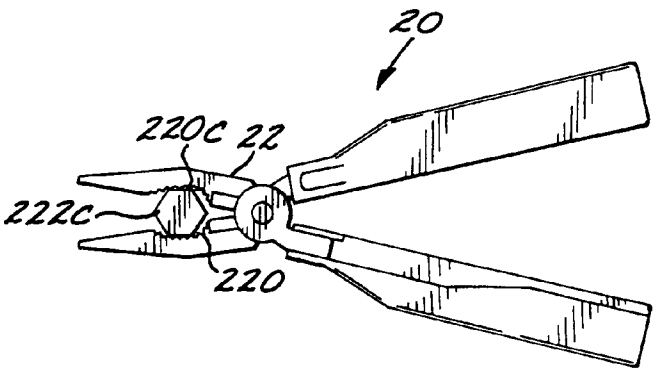
Figure 14D:
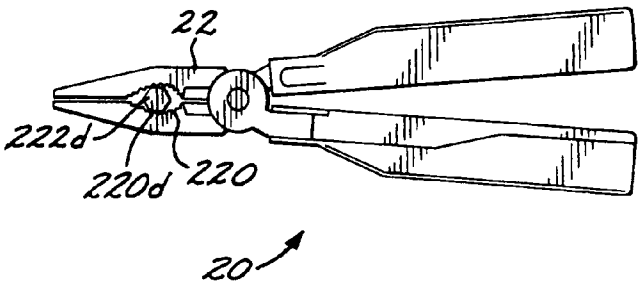

In the second modification illustrated in FIG. 13A, the shape of the blade of the blade tool 32 is provided with a stop recess 210 for the transversely extending rocker axle 60. If the stop recess 210 were not present, it would be necessary to make the blade tool 32 narrower to fit within the available height constraint H, as shown in FIG. 13B. The stop recess 210 also acts as a stop against the blade tool 32 being forced too far in a clockwise direction as shown in FIG. 13A during closing of the blade tool 32.

In the third modification illustrated in FIGS. 14A–D, an internally recessed and serrated portion 220 of the pliers head is modified so that its serrated region can accurately grasp a variety of sizes of articles, in this case illustrated as a bolt head 222. The serrated portion 220 is not semicircular or other regular shape. Instead, it is structured so that a forwardmost portion 220*a* grasps a large, I-inch bolt head 222*a*, FIG. 14A. An intermediate portion 220*b* grasps a ¾-inch bolt head 222*b*, FIG. 14B. A central portion 220*c* grasps a ½-inch bolt head 222*c*, FIG. 14C. The gap between the opposing sides of the serrated portion 220 is dimensioned to be large enough to grasp a ¼-inch bolt head 222*d*, FIG. 14D.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A combination tool, comprising:

a pair of handles, a first end of each being deployably joined to one of a pair of pivotably interconnected members, at least a first handle of said pair having a pair of oppositely disposed sides;

an axle extending transversely between the sides of the first handle at a second end thereof;

at least two blades supported on the axle, each blade being rotatable between a closed position wherein the blade lies between the oppositely disposed sides of the first handle and an open position wherein the blade extends from the second end of the first handle, each blade including a flat blade base having a peripheral surface, a bore through the base blade with the axle extending through the bore, and an implement extending outwardly from the blade base; and a single engagement element supported on the first handle and having a locking finger extending and biased toward the peripheral surfaces of the blade bases from a first end of the single engagement element, the locking finger engaging each blade when that blade is in the open position to lock the blade positively into the open position; and a single manually accessible release, the single release being operable to disengage the locking finger from the blade that is in the open position, while permitting the other blades to remain in the closed position.

2. The combination tool of claim 1, wherein the at least two blades comprises at least three blades.

3. The combination tool of claim 1, wherein the single engagement element biases the remaining blades, other than the blade that is in the open position, toward their closed positions.

4. The combination tool of claim 1, wherein said engagement element is a rocker supported by and located between the oppositely disposed sides of the first handle.

5. The combination tool of claim 4, wherein the rocker is pivotably supported on a rocker axle extending between the oppositely disposed sides of the first handle.

6. A combination tool comprising:

a pair of handles, a first end of each being deployably joined to a respective one of a pair of pivotably interconnected members, at least a first handle of said pair having a pair of oppositely disposed sides and a structure interconnecting the two sides with each other;

an axle extending transversely between the sides of the first handle at a second end of the first handle;

at least two blades pivotably supported on the axle, each of the blades being independently rotatable in the same rotational direction between a closed position wherein the blade is nested between the sides of the handle and an open position wherein the blade extends outwardly from the handle; and a locking mechanism mounted on the first handle that positively locks a selected one of the at least two blades into its open position and that has a single release operable to unlock the selected blade from the open position while the remaining blades of said at least two blades remain in the closed position.

7. The combination tool of claim 6, wherein the locking mechanism biases the remaining blades, other than the selected blade, toward their closed positions.

8. A combination tool comprising:

a pair of handles, a first end of each being deployably joined to a respective one of a pair of pivotably interconnected members, at least a first handle of said pair having a pair of oppositely disposed sides and a structure interconnecting the two sides with each other, each of said pair of handles being movable relative to the respective one of said interconnected members, and said interconnected members being capable of nesting between said oppositely disposed sides;

an axle extending transversely between the sides of the first handle at a second end of the first handle;

at least two blades pivotably supported on the axle, each of the blades being independently rotatable in the same rotational direction between a closed position wherein the blade is nested between the sides of the handle and an open position wherein the blade extends outwardly from the handle; and a locking mechanism mounted on the first handle that positively locks a selected one of the at least two blades into its open position and that has a single release operable to unlock the selected blade from the open position while the remaining blades of said at least two blades remain in the closed position.

9. The combination tool of claim 8, wherein the locking mechanism biases the remaining blades, other than the selected blade, toward their closed positions.

* * * * *